United States Patent [19]

Barton

[11] 4,186,968

[45] Feb. 5, 1980

[54] ROADWAY PAVEMENT PLANING MACHINE

[75] Inventor: Robert M. Barton, Oklahoma City, Okla.

[73] Assignee: Barco Manufacturing Company, Oklahoma City, Okla.

[21] Appl. No.: 942,618

[22] Filed: Sep. 15, 1978

Related U.S. Application Data

[63] Continuation of Ser. No. 784,556, Apr. 4, 1977, abandoned.

[51] Int. Cl.[2] ..... E01C 23/12

[52] U.S. Cl. ..... 299/39; 299/89; 404/90

[58] Field of Search ..... 404/75, 84, 90, 91, 404/98; 299/39, 89

[56] References Cited

U.S. PATENT DOCUMENTS

| | | | |
|---|---|---|---|
| 2,801,838 | 8/1957 | Bradley | 299/89 |
| 3,306,669 | 2/1967 | Christensen | 299/89 |
| 3,452,461 | 7/1969 | Hanson | 404/91 X |
| 3,606,468 | 9/1971 | Walker | 299/39 |
| 3,767,262 | 10/1973 | Pentith | 299/39 |
| 3,888,542 | 6/1975 | Gowler | 299/39 X |
| 3,893,780 | 7/1975 | Gutman | 404/91 |
| 4,029,165 | 6/1977 | Miller | 404/98 |

FOREIGN PATENT DOCUMENTS

| | | | |
|---|---|---|---|
| 530654 | 7/1931 | Fed. Rep. of Germany | 299/31 |

*Primary Examiner*—William F. Pate, III

*Attorney, Agent, or Firm*—McWilliams, Mann & Zummer

[57] ABSTRACT

A roadway pavement planing machine comprising a frame having forward and rearward ends, a pair of crawler drive assemblies disposed in side by side relation at the frame forward end upon which the frame forward end rests, with such drive assemblies being connected to the frame for independent vertical adjustment of said frame relative to the respective forward drive assemblies, a drive assembly adjacent the frame rearward end on which the frame rearward end rests and comprising a pair of crawler type drive assemblies. The rearward end drive assembly as a whole is connected to the machine frame for movement of the frame about a horizontal axis extending longitudinally of the frame. The frame has a planing cylinder journaled on same that extends crosswise of same and is disposed for planing engagement with the pavement, with the planing cylinder being disposed intermediate the frame forward and rearward ends and having external surfacing including gouging cutting studs for fragmenting the pavement in planing same when rotated against the pavement surface.

15 Claims, 14 Drawing Figures

ROADWAY PAVEMENT PLANING MACHINE

This application is a continuation of my abandoned copending application Ser. No. 784,556, filed Apr. 4, 1977.

This invention relates to road pavement resurfacing machines, and more particularly to equipment for resurfacing roadways that is especially adapted to remove a part or all of a roadway pavement for resurfacing or replacement purposes.

In the highway maintenance field, in recent years several factors have emerged emphasizing the need for creative thinking to provide new ways and means of economically restoring riding quality and skid resistance to the surface of modern highway pavement, which normally is made up of either asphalt or concrete. The need for answers to these problems is highlighted by the realization by highway engineers that for various reasons pavement surfaces must be given attention sooner than was originally anticipated. Thus, heavy traffic volumes and the use of studded tires are causing the now familiar "wheel path rutting" as well as aggregate polishing with consequent rapid loss of skid resistance. In addition, increasing numbers and load weights of truck traffic have resulted in noticeably increased joint faulting and "washboarding".

With the increased emphasis on safety that has emerged in recent years, many state and local governments have established programs to detect and identify roadways that have become hazardous due to deterioration of pavement surfacing in one way or another, due to factors such as those referred to above as well as others that may be the result of local conditions. Both the general public and state and local highway department officials now have an awareness that governing laws establish an obligation to provide good roadways, and in particular roadway pavement that is at least reasonably safe for the purpose of travel. Claims of parties injured as the result of skidding accidents are finding response in the courts by way of large sums being awarded as compensatory and other damages.

Heretofore the most frequent remedial maintenance procedure employed to restore highway pavement riding quality and skid resistance has been to overlay the existing roadway pavement with asphalt. While this approach is a popular and effective way of correcting these problems, the economics involved and the energy shortage has caused the cost of asphalt to so drastically increase that costs of maintenance of this type are running well ahead of available funds once thought adequate for solving problems of this type. Furthermore, the public is becoming increasingly cost conscious and resistance to imposition of additional tax burdens that would normally be the source of much of the funding needed to meet highway maintenance costs, which has created a serious dilemma in view of the fact that highway vehicle traffic continues to increase from year to year in spite of the energy shortage.

It has become increasingly apparent that the usual approach of resurfacing pavement with asphalt, to correct pavement surfacing problems, will have to be seriously curtailed because of the economic problems involved alone. However, there are other practical problems involved, such as each time a roadway is resurfaced by using overlay procedures, the successive layers involved raise the height of the roadway, which has the result of interferring with natural drainage, fills up existing guttering, and in the case of underpasses reduces overhead room. Where overlaying is done across bridges, each overlay applied to the bridge adds to the dead weight that the bridge must carry with the resulting safety implications.

Some thought has been given to other ways of effecting correction of defective pavement surfacing. The sawing of grooves and grinding has proved successful on a limited basis, but both these methods are too expensive to be used in other than special problem areas where they are best suited in view of special circumstances. The handling of pavement residue resulting from these procedures has been a problem and the refuse involved has no salvageable value. Another approach that has been tried involves efforts to plane asphaltic surfacing by utilizing heater planing apparatus. This equipment is known to be dangerous and noisy, and unduly pollutes the atmosphere in use. As the procedures involved are concerned primarily with leveling of the pavement surface and little if any of the material making up the defective pavement is reclaimed, this type of equipment cannot be given much serious consideration as a real problem solver in this field.

Serious consideration is now being given to try to find ways to recycle the materials making up roadway pavement, not only because of the increasingly higher costs of obtaining petroleum based products, but also due to the increasing scarcity of quality aggregates and increasing costs of transporting same from point of source to point of use including any processing as to grade or the like that may be involved.

A principal object of this invention is to provide a pavement planing machine that, as it operates, effects a breaking up of the pavement surfacing that is being treated and providing for pick up and conveyance to waiting bulk material receiving vehicles the resulting pavement rubble that may then be suitably processed for recycling purposes.

Another principal object of the invention is to provide a pavement planing machine of the type indicated that will handle both asphalt or concrete with facility while providing for good grade control for establishing the desired pavement surface grade and profile best suited for any given situation.

Another important object of the invention is to provide a roadway planing machine of the rotary planer type that cuts a swath of eight feet or more across the width of the roadway at a single pass while providing for accurate grade control best suited for the desired riding condition to be obtained for a particular roadway.

Another important object of the invention is to provide a roadway pavement planing machine on which the planer drive is mounted for maximum efficiency of drive application, protection from working and atmospheric conditions, and safety for those operating the machine.

Yet other objects of the invention are to provide a roadway pavement planing machine that provides for maximum pickup of the resulting pavement rubble and conveying of same for efficient deposit in suitable pickup vehicles, while the planing type resurfacing action is performed by the machine.

Still other objects of the invention are to provide a roadway pavement planing machine that removes some or all of the existing pavement for recycling purposes, that operates free of atmospheric and noise pollution, and is economical of manufacture, and that is safe, reliable, and long lived in operation.

Other objects, uses, and advantages will be obvious or become apparent from a consideration of the following detailed description and the application drawings in which like reference numerals indicate like parts throughout the several views.

However, it should be distinctly understood that the specific drawing illustrations provided are supplied primarily to comply with the requirements of the Patent Laws, and that the invention is susceptible of modifications and variations that will be obvious to those skilled in the art, and which are intended to be covered by the appended claims.

GENERAL DESCRIPTION

Figures 1, 1A:
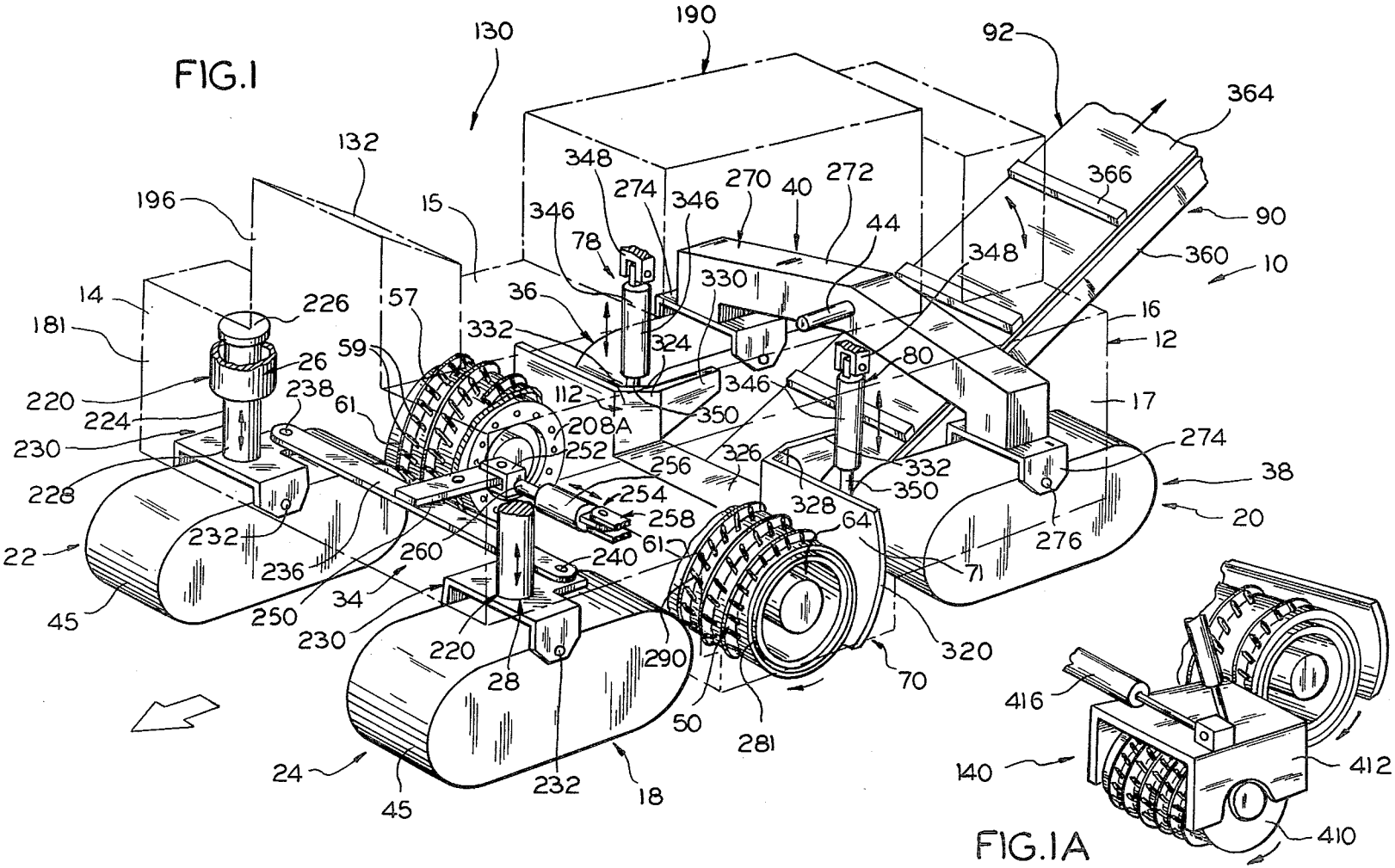
FIG. 1 is a diagrammatic perspective view, largely in block diagram form, illustrating the basic arrangement of a roadway pavement planing machine arranged in accordance with the invention.
FIG. 1A is a fragmental perspective view of the nature similar to that of FIG. 1 illustrating a modified form of the invention.
Figure 2:
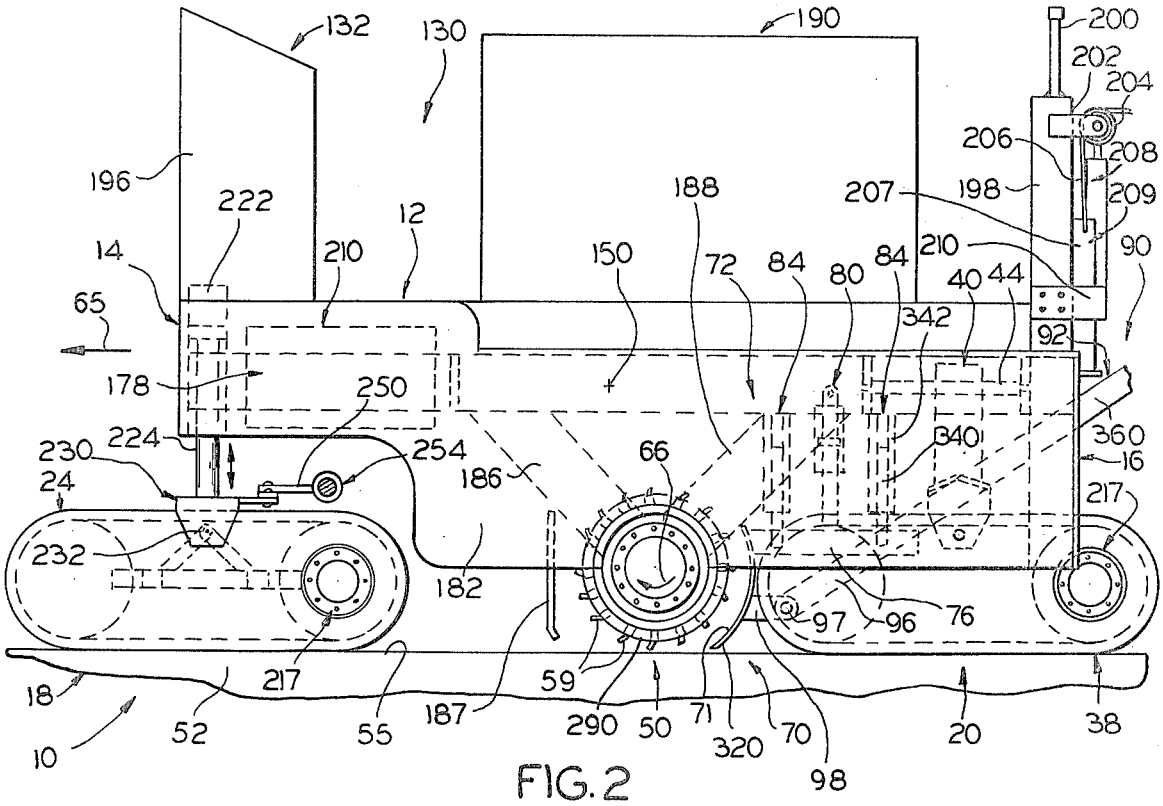
FIG. 2 is a side elevational view of the machine shown in FIG. 1, taken from the right hand side of the machine as shown in FIG. 1.
Figures 9, 10, 11, 12, 13:
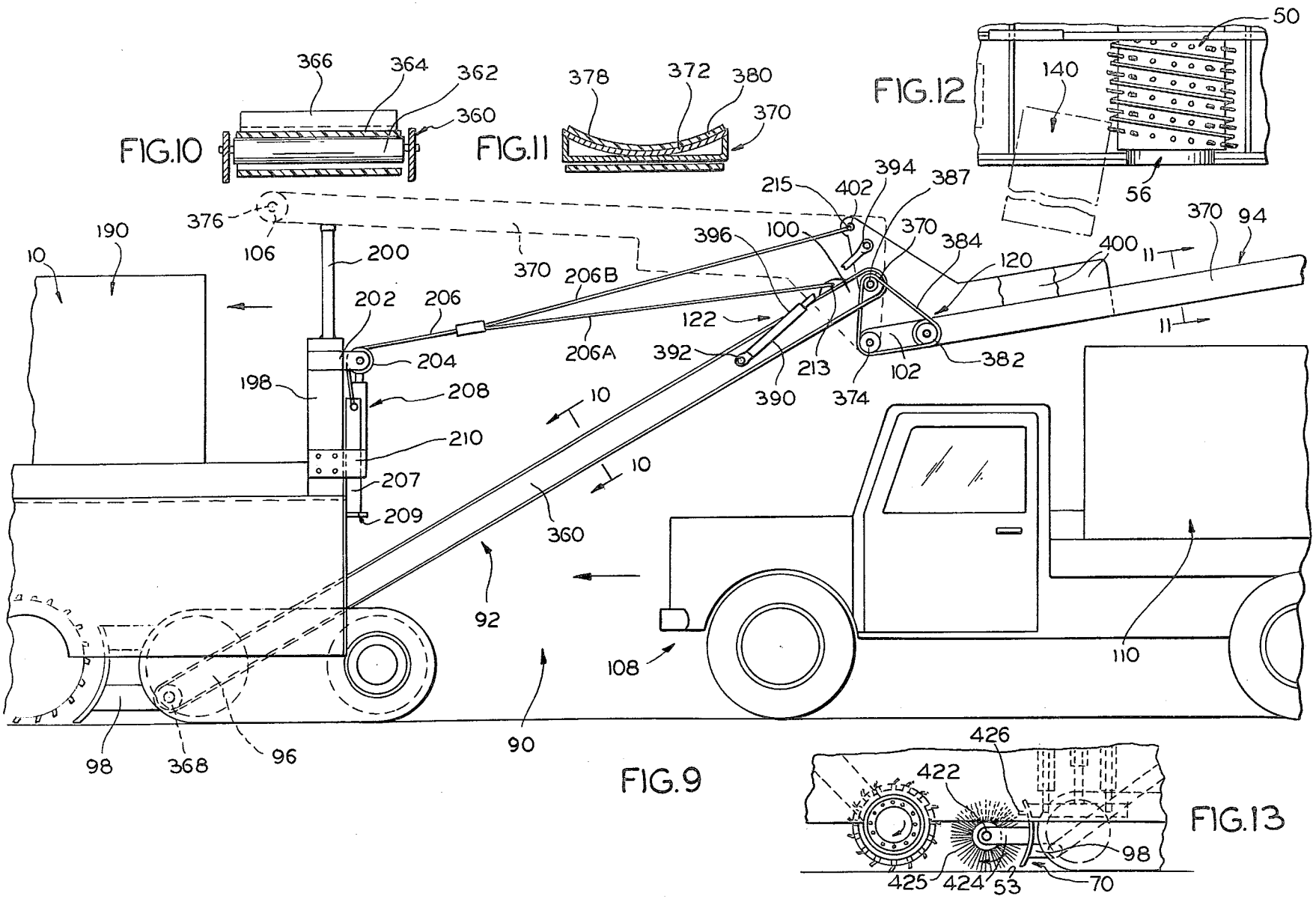
FIG. 9 is a view similar to that of FIG. 2 but with emphasis on the rear end of the machine and specifically the conveyor assembly as arranged for conveying the pavement removed by the machine to a waiting vehicle for recycling purposes.
FIG. 10 is a sectional view taken substantially along line 10—10 of FIG. 9.
FIG. 11 is a sectional view taken substantially along line 11—11 of FIG. 9.
FIG. 12 is a fragmental plan view of the machine adjacent one end of the planer, showing the modification of FIG. 1A in outline.
FIG. 13 is a fragmental view showing the cutter drum associated with a rotary brush arrangement.

Reference numeral 10 of FIGS. 1, 2 and 9 generally indicate a specific embodiment of the invention which comprises a frame 12 having a front end 14 and a rear end 16, with the front end 14 being supported on a front drive assembly 18 and the frame rear end 16 being supported on a rear drive assembly 20.

The front drive assembly 18 comprises a pair of crawler assemblies 22 and 24 connected to the forward end 14 of frame 12 through the respective hydraulic cylinder devices 26 and 28 for pivotal movement about the respective vertical axes 30 and 32 (see FIG. 3) as well as selective vertical adjustment of the frame forward end 14 with respect to the respective assemblies 22 and 24. The assemblies 22 and 24 are operably connected together for vehicle steering purposes by steering mechanism 34.

Figure 3:
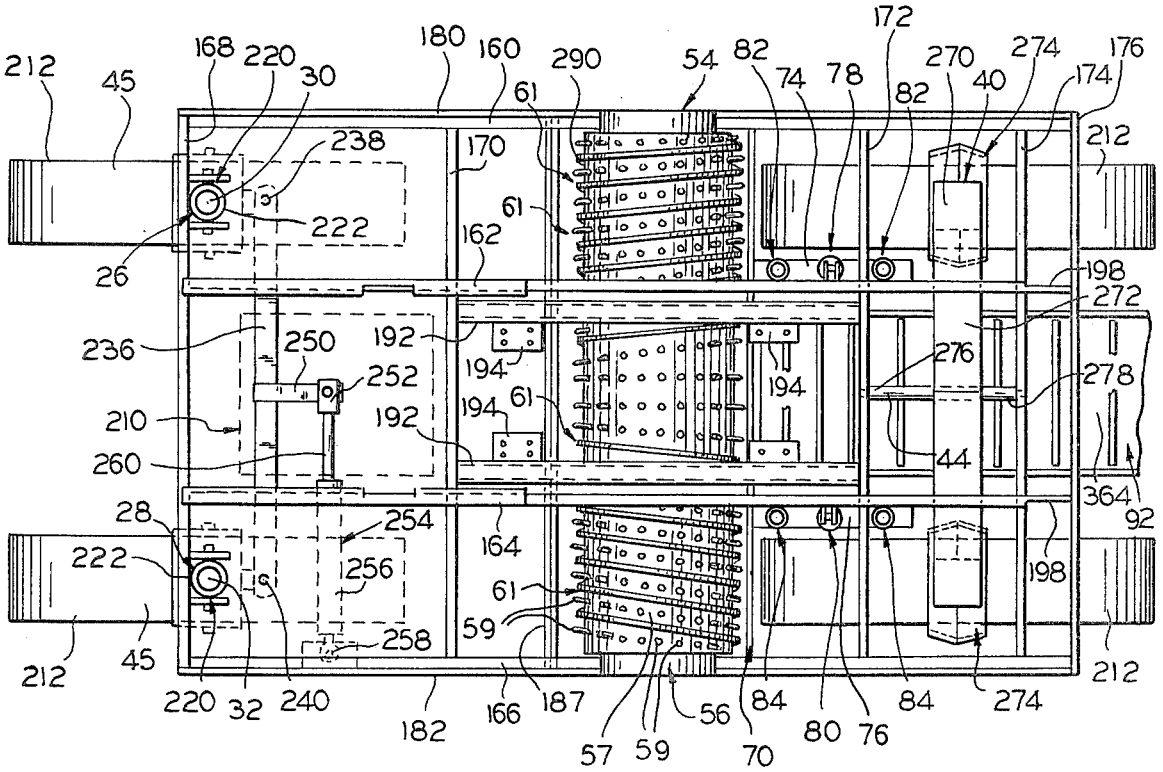
FIG. 3 is a diagrammatic plan view of the machine shown in FIGS. 1 and 2, showing only the main components of the machine frame, the rotary planer, the machine crawler assemblies, the pavement rubble receiving conveyor, and associate parts.
Figure 4:
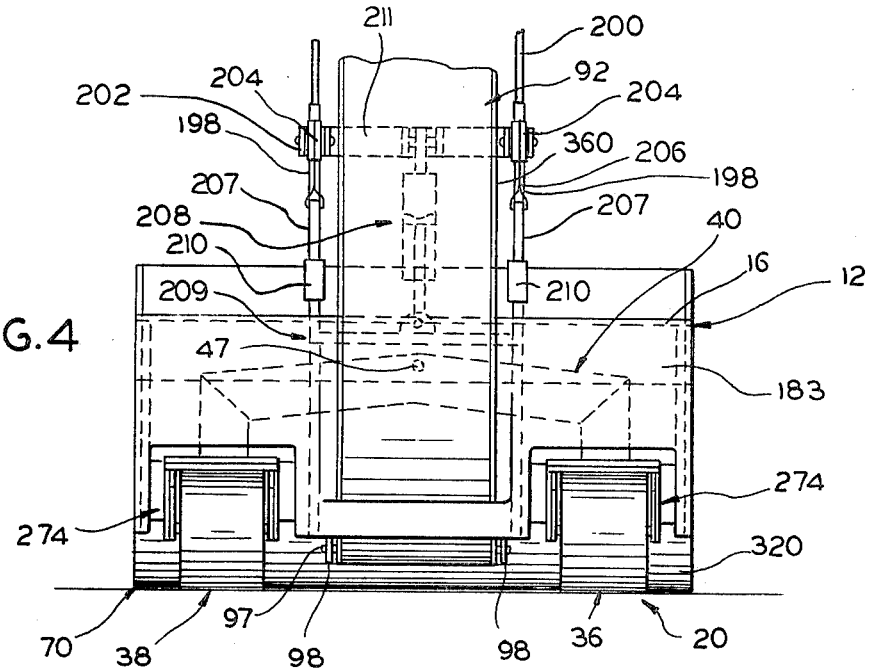
FIG. 4 is an end view of the machine as shown in FIG. 2 taken from the right hand or rear end of the machine as shown in FIG. 2.

The rear drive assembly 20 comprises a pair of crawler assemblies 36 and 38 connected together by yoke structure 40 that is pivotally connected to frame 12 at its rear end 16 for pivotal movement about horizontal axis 42 (see FIGS. 3 and 4). In the embodiment illustrated, the yoke structure 40 includes shaft 44 fixed thereto which is journaled in frame 16 or pivotal movement about axis 42, which axis 42 extends longitudinally of the frame 12, and in particular the direction of intended movement of the machine 10.

The crawler assemblies 22, 24, 36 and 38 are suitably powered or driven, as by employing conventional hydraulic drive motor equipment which provides for both forward and reverse movement of the vehicle.

Intermediate the assemblies 18 and 20 frame 12 journals planing cylinder or cutter drum 50 that extends transversely of the machine 10 and crosswise of the intended direction of movement of same for planing engagement with pavement 52. The planing cylinder 50 is journaled between hubs 54 and 56 respectively fixed to the sides 15 and 17 of the frame 12. In the specific arrangement illustrated, the planing cylinder 50 at either end of same is connected to the respective hubs 54 and 56 by drive mechanism 58 (see FIGS. 5 and 8), that in each instance, is connected to the planing cylinder at 60 and to the respective hubs at 62 (using suitable bolts 63 or the like for this purpose) for journaling the planing cylinder on frame 16. The respective drives 58 are driven by suitable hydraulic motors 64 to normally rotate the planing cylinder 50 in the direction indicated by the arrow 66 of FIG. 2 when machine 10 is moved along the roadway being processed in the direction indicated by the arrow 65 of FIG. 2 for upcutting excisement of pavement 52 (note FIGS. 2 and 7). While the direction of rotation 66 is the normal direction of rotation of the planer cylinder 50, it is preferred that the drive 58 and the drive motor 64 therefor in each instance be reversably operable at the option of the machine operator.

It will be observed that the journaling and drive arrangement for planer cylinder 50 is housed thereby in coaxial relation therewith for maximum efficiency of application and protection of the drive equipment involved.

Operably associated with the planing cylinder 50 is mold board 70 that forms a part of mounting assembly 72 that includes a pair of mounting bars 74 and 76 that are fixed with respect to the mold board 70 and extend rearwardly thereof. The mounting bars 74 and 76 are connected to frame 16 by the respective hydraulic cylinder devices 78 and 80 for vertical adjustment of the mold board with respect to frame 12, devices 78 and 80 being suitably resiliently connected to frame 12 for adequate shock absorption purposes. Operably associated with the respective mounting bars 74 and 76 are the respective vertical movement guidance devices 82 and 84 (not shown in FIG. 1).

The machine 10 includes conveyor assembly 90 that projects upwardly and rearwardly thereof from mold board 70 and comprises inner or lower conveyor assembly 92 and outer or upper conveyor assembly 94. The inner conveyor assembly 92 has its lower end 96 pivotally secured, as at 97, to the respective spaced apart mounting brackets 98 that in the form shown are fixed to mold board 70, whereby the lower end 96 of the conveyor assembly 92 is supported by mounting assembly 72 well forwardly of yoke structure shaft 44 and well below the level of its axis 42 (see FIG. 2). The conveyor assembly 92 at its upper end 100 mounts cantilever fashion the conveyor assembly 94 adjacent the inner end 102 of the conveyor assembly 94, the outer end 106 of assembly 94, in the operating position of the conveyor assembly 90, being disposed in the rearwardly and outwardly projecting relation suggested in FIG. 9 for arranging the conveyor apparatus 90 to receive beneath same a conventional highway dump vehicle 108 equipped with the familiar dump vehicle body 110 adapted to receive from a conveyor assembly 90 bulk material conveyed thereby for discharge from machine 10.

Mold board 70 is formed with funneling port 112 for receiving pavement rubble removed from pavement 52 by the operation of planer cylinder 50, for deposit on conveyor assembly 92 which conveys the pavement rubble material in question to conveyor assembly 94 for discharge into the vehicle 108.

Both the conveyor assemblies 92 and 94 are driven by drive mechanism 120 that is located at the ends 100 and 102 of the respective conveyor assemblies 92 and 94. The conveyor assembly 94 is movable to the dashed line retracted position indicated in FIG. 9 by operating hydraulic cylinder assembly 122.

In operation, the machine 10 when located at the site of the pavement to be planed or profiled, has its hydraulic cylinder devices 26 and 28 at its front end 14 adjusted to set the planing cylinder or cutter drum 50 at the desired grade and slope for a planed pavement surface 53 (see FIG. 7), as compared to the existing pavement surface 55, drum 50 being operated as necessary to reach this setting relative to surface 55. The hydraulic cylinder devices 26 and 28 are arranged for individual operation independent of each other for selectively positioning each side of the frame 12 relative to the respective drive assemblies 22 and 24 to set the planing cylinder 50, relative to a suitable grade defining datum that has been conventionally established for the new pavement surface to be provided by the use of the machine 10. In making this setting of the planing cylinder 70, the frame 12 of machine 10, at the rear end of the frame 12, merely pivots to one side or the other about axis 42.

The hydraulic cylinder devices 78 and 80 are operated as the machine moves forwardly to dispose the mold board 70 elevationally relative to the planing cylinder 50 for proper mold board positioning relative thereto that will insure pick up of substantially all of the rubble formed by the operation of planar cylinder 50. The conveyor assembly 90, and in particular the assembly 94 thereof, is moved to its extended operative position indicated by FIG. 9.

When the machine 10 is put into operation, the drive assemblies 22, 24, 36 and 38 move the machine 10 along the right of way, over the pavement segment being processed, while the planing cylinder 50 is rotated in the direction indicated by the arrow 66 for upcutting planing excisement thereof. The planing cylinder 50 has its side wall 57 equipped with gouging type cutters 59 of any suitable design arranged for gouging type pavement break up action on the pavement when rotated thereagainst, and auger flanging or flighting 61 oriented to feed pavement rubble broken up by the action of the cutting devices 59 toward the mold board port 112, as the planar cylinder 50 rotates in operation. Forward movement of machine 10 also induces a movement of pavement rubble gathered by mold board 70 upwardly of the mold board working face 71. Thus, pavement rubble excised by planar cylinder 50 may move over the top of cylinder 50 and into the working space 73 between the cylinder 50 and mold board 70 where the auger action of flanging or flighting 61 on the broken up pavement in space 73 centers such material for uniform flowing action through port 112 and onto conveyor assembly 92.

As the machine 10 proceeds along the roadway, it is steered by the operator standing at operating location 130, and using control panel 132 on which the various controls for the various operating components of the machine are mounted for convenience of operation by the operator. Pavement rubble proceeding through the mold board port 112 drops onto conveyor assembly 92 that conveys it rearwardly and upwardly of frame 12 under yoke structure shaft 44 and then through and above the level of axis 42 to conveyor assembly 94 for further conveyance and deposit in a waiting vehicle 108, which may, because of the particular arrangement of the conveyor assembly 90, follow along behind the machine 10 and under conveyor assembly 90, while moving in a forward direction, and at speeds comparable to the speed of the machine 10, for receiving the pavement rubble from the discharge end of conveyor assembly 94. The conveyor assembly 94 is preferably proportioned in length to have its discharge end 106 extend well beyond the location of the vertical plane of the center of gravity of vehicles 108 of standard sizes. The operator of the vehicle 108 by appropriately controlling the speed of his vehicle relative to the speed of machine 10, may move the dump body 110 forwardly and rearwardly of the conveyor assembly 94 to uniformly distribute the pavement rubble load along the length of the dump body 110.

In a preferred form of the invention, the planing cylinder 50 and cooperating mold board 70 are proportioned transversely of the machine 10 to provide a cutting swath approximating, but somewhat under, twelve feet (for instance 8.5 feet). In accordance with the invention, a full twelve foot cutting swath is provided by employing at either end of the planing cylinder 50 a set of supplementary planing assemblies 140 (see FIGS. 1A and 12).

Further in accordance with the invention, the machine 10, and in particular the frame 16 and components it carries, is oriented and arranged so that the center of gravity of the machine 10, indicated at 150 in FIG. 2, is vertically located above and in substantial alignment with the forwardly located margin of the planing cylinder 50, with the weight supported by the respective crawler assemblies 22, 24, 36 and 38 being substantially equal for each such assembly. This arrangement centers and orients the weight of the machine, with respect to cylinder 50, to best advantage to counter the upward forces acting on the planing cylinder 50 as the machine 10 moves in a forward direction, in operation.

As the machine 10 operates, the pavement, whether it be asphalt or concrete, is planed or excised to the desired grade and slope to provide a pavement surfacing that is suitable for itself serving as highway traffic surfacing, or to which may be applied in any suitable manner the new pavement material (which ordinarily would be asphalt). Pavement rubble removed by the machine 10 is suitable for recycling, and for this purpose the location and spacing of the cutters 59 may be as desired for achieving a particular aggregate size. The pavement rubble resulting is thus broken up to the proper gradiation for use, the vehicles 108 being employed to take the newly formed aggregate material to a recycling center for reuse. A large percentage of the pavement removed from the roadway by the practice of the invention is useable for the indicated recycling purposes, with liquid asphalt and aggregate being added as needed.

SPECIFIC DESCRIPTION

The frame 10 is basically only diagrammatically illustrated as, generally speaking, its specifics may take any suitable form. The frame is thus shown as being of rectangular configuration (see FIG. 3) involving suitable longitudinally extending members 160, 162, 164 and 166 integrated with suitable transverse frame members 168, 170, 172, 174 and 176 to provide a basic subframe indicated by reference numeral 178 that is of essentially planar construction, to which suitable body plating or the like is applied, as indicated at 180, 181, 182 and 183. An important aspect of the invention is that at the sides of the machine 10, side plates 180 and 182 be made part of the frame 16, to which the respective hubs 54 and 56 are respectively fixed. It is preferred that the side plates 180 and 182 in the areas of the hubs 54 and 56 be sufficiently flexible laterally of the vehicle to provide sufficient flexture for proper operating self alignment of the respective hubs 54 and 56 with respect to the planing cylinder 50.

As indicated in FIG. 2, the respective hubs 54 and 56 have reinforcing plates 186 and 188 fixed to the respective plates 180 and 182 and extending between the respective hubs and frame 178 (on the inside surfaces of the plates 180 and 182), for reinforcing and supporting purposes. A forward pavement rubble retainer plate 187 is disposed adjacent to and forward of cutter drum 50 (to keep the pavement adjacent drum 50) by being suitably secured between the frame side plates 180 and 182.

The frame 16 mounts suitable main motor 190 that is to form the prime mover of the machine 10 and may be a diesel engine of suitable capacity for providing the driving power to operate all of the drives associated with the machine 10. Motor mounting frame members 192 and motor mounting brackets 194 affixed thereto may be provided for this purpose. The frame 16 also is provided with an operator instrument pedestal 196 on which the instrument panel 132 is formed as well as suitable guard railing (not shown) about the upper margin of the frame 16 for safety purposes. At the rear end of frame 16 the frame includes a pair of spaced apart upright members 198 between which is mounted a U-shaped support 200 in inverted position upon which the conveyor assembly 94 rests when in its retracted position of FIG. 9. The members 198 also mount suitable brackets 202 in which pulleys 204 are journaled over which are trained support cables 206 connected between either side of the conveyor assembly 92 and the respective arms 207 of yoke 209 that is slidably mounted in the respective support guides 210 for vertical shifting movement under the control of hydraulic cylinder device 208 that is interposed between yoke 209 and frame member 211 fixed between brackets 202. The respective cables 206 have linking sections 206A and 206B connected to the conveyor assembly where indicated at 213 and 215. Extension and retraction of device 208 adjusts the angulation of the conveyor assembly 90.

The frame 16 underneath the operator's position 130 is also arranged to provide an equipment module indicated by reference numeral 210 (see FIGS. 2 and 3) in which the equipment for furnishing hydraulic pressure liquid to the respective hydraulic cylinder devices forming a part of machine 10 may be operably mounted as part of the distribution of the mass of the frame 16 to achieve the indicated desired location of the machine center of gravity 150.

The crawler assemblies 22, 24, 36 and 38 may be of any suitable commercial type equipped with the usual hydraulic drive motors 217 for effecting the application of forward and reverse driving movement to the usual endless tracks 212 of the respective crawler assemblies.

The hydraulic cylinder devices 26 and 28 are only diagrammatically illustrated, as they may comprise any suitable hydraulic cylinder unit 220 comprising a suitable hydraulic cylinder 222 suitably anchored in frame 16 in vertically disposed relation and reciprocably receiving ram 224 having ram head 226 operably mounted within cylinder 220 and shank 228 fixed to clevis structure 230 pivoted by suitable pins 232 to the frames (not shown) of the respective crawler assemblies 22 and 24. The rams 224 are received within the respective cylinders 220 for swiveling movement about the respective axes 30 and 32 (with which the respective rams 224 coincide) under the steering operation of steering assembly 34, which comprises cross bar 236 pivotally connected as at 238 and 240, respectively, to the respective clevis structures 230. Cross member 236 has fixed thereto as by welding a lever arm 250 pivotally connected to clevis 252 of hydraulic cylinder device 254 having hydraulic cylinder 256 pivotally connected to the frame 16 as at 258 and piston rod 260 operably and reciprocably mounted therein to which the clevis 252 is suitably affixed.

As to the rear drive assembly 20, the yoke structure 40 comprises a fabricated yoke 270 having a shank 272 equipped with a clevis structure 274 at either end thereof, which clevis structures 274 are pivotally connected as at 276 to the frames (not shown) of the respective crawler assemblies 36 and 38.

The yoke shank 272 has affixed to same the shaft 44 which has its end portions 276 and 278 suitably journaled in the frame cross members 172 and 174, as indicated in FIG. 3, for pivotal movement about the indicated horizontal axis 42 that extends coplanar with the frame portion 178 (see FIG. 2).

Figure 5:
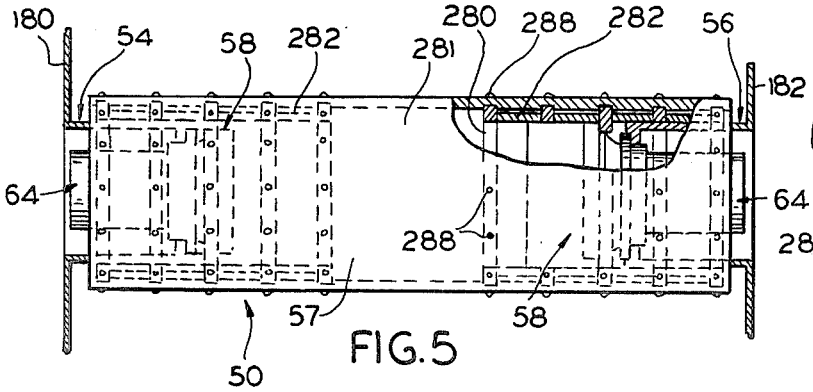
FIG. 5 is a plan view of the rotary planer as mounted in the machine, with associated parts being partially broken away and shown in section and the planer drive arrangement shown in phantom.
Figure 6:
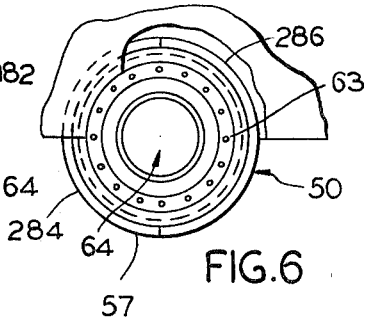
FIG. 6 is an end view of the structure shown in FIG. 5.
Figure 8:
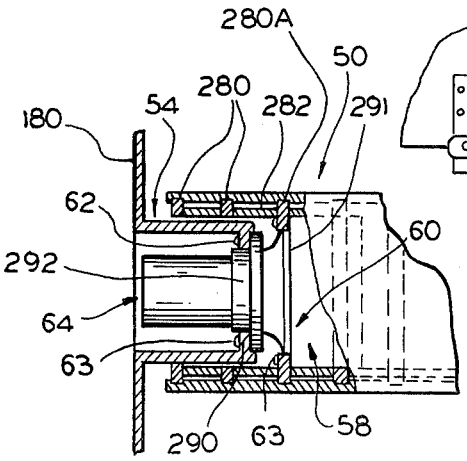
FIG. 8 is a showing of the left hand end of the structure shown in FIG. 5, with parts broken away and shown in section for better illustrating the planer mounting and driving arrangement in accordance with the invention.

The planing cylinder 50 is of coreless annular configuration as shown in FIGS. 5 and 8, comprises an annular coreless framework comprising a plurality of rings or annular segments 280 (see FIGS. 5 and 8) fixed together in spaced apart relation at either end of the planing cylinder 50 by employing suitable spacer bars or plates 282 welded therebetween as suggested by FIGS. 5 and 8. The cylinder side wall, 57 in accordance with the present invention, comprises a plurality (a pair in the illustrated embodiment) of shell sections 284 and 286 affixed to the respective rings 280 (by employing suitable bolts 288), to define cylindrically contoured shell 281. When a sufficient number of the cutters 59 need repair or replacement, this can be conveniently effected in the field by removing the plates 284 and 286 and replacing them with corresponding plates equipped with fresh cutting implements. It is to be noted from FIGS. 5 and 8 that the basic mass of cylinder 50 is distributed in an annular configuration about the axis of rotation of cylinder 50 adjacent the movement paths of cutters 59.

The auger forming flanges or flighting 61 comprise helically contoured plates 290 suitably welded to the respective plates 284 and 286 to give the helical contour required to provide the desired feeding action of the pavement particles involved toward the central portion of mold board 70, from either end of same when machine 10 is operating, as will be apparent to those skilled in the art. The cutting or gouging elements 59 and associated plates 290 may be applied to the plates 284 and 286 with the spacing desired to achieve a particular grade of break up of the pavement material being processed by the machine 10, as will also be apparent to those skilled in the art.

The planar cylindeer drives 58 are only diagrammatically illustrated as they may be of any suitable type, such as the gear driven planetary drive made and sold by Fairfield Manufacturing Co., Inc. of Lafayette, Indiana, under the trademark TORQUE HUB. For this purpose, the planing cylinder 50 at either end of same has a framing ring 280A of increased internal diameter for bolting to the movable portion 291 of the drive 58 as at 60, while the respective hubs 54 are formed with internal flanges 290 for bolting to the relatively stationary component 292 of the drive 58 as at 62. The respective motors 64 (which may be of any suitable type) are suitably mounted on the drive stationary components 292 and are disposed within the respective hubs 54, as indicated in FIG. 8. This drive arrangement allows the drive for cutter 50 to be housed within same without the need for parts protruding beyond the width of frame 12. The need for drive chains and the like, and especially exposed drive chains at either side of the machine, is also avoided.

Figure 7:
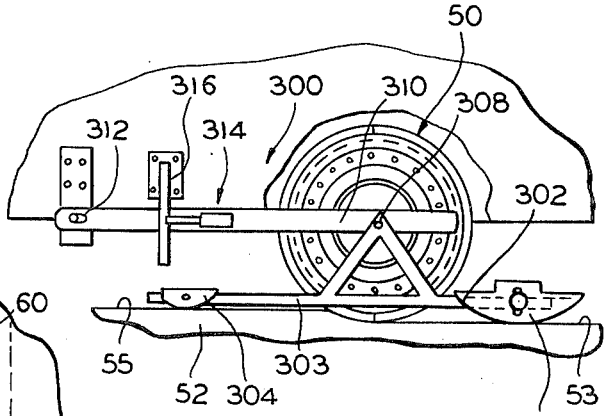
FIG. 7 is a view similar to that of FIG. 6, but diagrammatically illustrating a sensing arrangement that may be employed in association with the machine for establishing and maintaining pavement surface grade as the machine is operated.

There is preferably mounted at either end of the planer cylinder 50 a sensing device for effecting continual sensing of the location of the planing cylinder 50 relative to the pavement being excised thereby. For illustrative purposes, a sensing device 300 is shown in FIG. 7 comprising a frame 302 having pavement engaging runners or skies 304 and 306 that respectively ride on the pavement at the old and new levels 55 and 53, which frame 302 is pivotally connected as at 308 to swing lever member 310 suitably pivoted as at 312 to frame 16 and carrying a suitable sensor 114 of any suitable type that is arranged electronically or otherwise to sense the position of the swing lever 310 relative to a datum bar 316 fixed to frame 16 and communicate the data involved to suitable control devices for controlling the operation of cylinder devices 220 and thus the grade positioning of planer cylinder 50, as indicated in FIG. 7. In accordance with the invention, the sensing device 300 at either end of the planing cylinder 50 is incorporated in the motivating controls for the respective hydraulic cylinder devices 26 and 28 to maintain the frame 60 so as to have the planing cylinder 50 excise the pavement at the desired grade level that has been predetermined for purposes of operating the machine 10.

For adjustment purposes, the runner 306 has its journaling arrangement arranged for limited vertical adjustment relative to the frame 302 for appropriately setting the device 300 for a particular difference in the levels of pavement surfaces 53 and 55, for disposing the base 303 of frame 302 in a horizontal operating position.

The mold board 70 comprises a fabricated plough shaped member 320 having an arcuate configuration transversely of same that roughly complements and is concentric with the arced configuration of the planar cylinder 50. The spacing of the member 320 from the paths of movement of the cutters 59 is made appropriate for insuring maximum feeding of the pavement rubble to the mold board port 112.

The mold board port 112 includes a funneling portion 322 defined by planer portions 324, 326 and 328 of the mold board, with the portions 324 and 328 being integral with rearwardly extending baffle portions 330 and 332, respectively, that restrict the downward flow of the pavement rubble to movement in alignment with the conveyor assembly 92.

The respective mounting members 74 and 76 are suitably affixed to the mold board member 320, as by welding, and are disposed in substantial parallelism to the plane of the frame 16 in their operating positions.

The movement guiding devices 82 and 84 are similar in construction, each comprising an upright bar 340 (see FIG. 2) fixed to the respective members 74 and 76 and received in telescoping guiding relation within a correspondingly located tubular member 342 fixed to the frame 16 in alignment therewith. The bars 340 and the bores of the tubular members 342 are of substantially complemental configuration with sufficient freedom to fit to accommodate easy sliding movement of the mold board and the components it supports relative to the frame 16, when the hydraulic cylinder devices 78 and 80 are operated to adjust same vertically.

The devices 78 and 80 in the form shown each comprise a hydraulic cylinder 346 suitably connected to frame 16 by suitable clevis 348 and having the piston rod 350 thereof suitably connected to the respective members 74 and 76. The piston rods 350, of course, have connected to same the usual pistons reciprocably mounted within the respective hydraulic cylinders 346.

The conveyor assembly 92 comprises suitable frame 360 journaling spaced rollers 362 that support cleated conveyor belt 364 provided with spaced cleats 366. The belt 364 is trained over end rollers 368 and 370 of the frame 360, with the rollers 370 being driven by hydraulic drive 120. As already indicated, the frame 360 at its lower end is pivotally connected to mounting brackets 98 that are suitably affixed to the mold board forming member 320.

The conveyor assembly 94 is of the slider bed type and comprises slider bed frame 370 that includes arcuate slider bed plate 372. Frame 370 is formed to journal end rollers 374 and 376 therein over which conveyor belt 378 is trained with the load carrying run 380 thereof sliding along the slider plate 372. The roller 374 is driven by drive 120, which comprises a suitable hydraulic motor 382 mounted on the frame 370 and driving drive chain 384 that engages in driving relation with suitable sprockets (not shown) that are keyed to the respective rollers 370 and 374. Conveyor assembly 94 at its end 102 is suspended from end 100 of conveyor assembly 92 by being pivotally connected thereto. Frame 370, for this purpose, is provided with the respective L-shaped flange structures 400 which flange structures 400 are suitably fixed to the frame 370 on either side of same, and frame 360 is pivotally connected between flange structures as at 387, which is aligned with the axis of rotation of roller 370.

Hydraulic cylinder assembly 122 comprises a pair of hydraulic cylinder devices 390 pivoted between the conveyor frames 360 and 370, as at 392 and 394, on either side of frames 360 and 370, with extension and retraction of devices 390 under the control of the operator swinging the conveyor 94 between its operative and inoperative positions shown in FIG. 9, and also providing for vertical adjustment of conveyor 94 when in its operative position.

The hydraulic cylinder devices 390 may comprise suitable units of this type each including the usual hydraulic cylinder and piston and piston rod assembly of appropriate length and capacity.

When the conveyor assembly 94 is to be moved between its positions indicated in FIG. 9, the hydraulic cylinder assemblies 390 are operatively actuated in a cooperative manner to move the frame 370 as well as conveyor assembly 94 between their indicated positions, with the conveyor assembly 94 pivoting about pivotal connection 397 in a controlled manner.

In accordance with the invention, the conveyor assembly 92 in operation is upwardly inclined approximately 30 degrees relative to the horizontal and has a length of approximately eighteen feet. Conveyor assembly 94 in operation is disposed to incline upwardly relative to the horizontal at an angle approximately ten degrees and has a length in the range of from approximately 10 to approximately 18 feet, depending on the length of the dump body 110 of the vehicle 108 employed. The conveyor assembly 94 is arranged to minimize its weight at its projecting end as well as its overall weight by locating its drive adjacent to its end 102 and making the conveyor assembly 94 of reduced width. For this purpose the slider bed plate 372 is arced transversely thereof to providing a cupping of the slider bed (transversely thereof) on the order of twenty degrees.

The various hydraulically operated and hydraulic assemblies disclosed may be connected for operation by suitable hydraulic pressure liquid supply systems of any convenient and conventional nature, as will be apparent to those skilled in the art.

When it is desired that the machine 10 provide a twelve foot planing swath, the supplemental planing assemblies 140 of FIGS. 1A and 12 are employed. These comprise a planer drum 410 suitably journaled in mounting frame 412 that is operably suspended from frame 16 by suitable hydraulic cylinder devices 414 and 416, for moving the assembly 140 between the operative positions diagrammatically illustrated in FIGS. 1A and 12, and suitably elevated retracted positions. In the showing of FIG. 12, the assembly 140 is indicated in outline only.

The assembly 140 may be comparable to that employed in the Galion FP-30 Roadplaner, made and sold by Galion Manufacturing Division of Dresser Industries Inc., Galion, Ohio.

In the showing of FIG. 13, machine 10A has rotary brush 420 interposed between the rotary cutter 50 and mold board 70. Brush 420 has a length approximating that of cutter 50 and is journalled for rotation about a horizontal axis 422 paralleling that of cutter 50, as by being journalled between bracket plates 424 fixed to either end of mold board 70 and disposed to have its periphery 425 approximately tangent to the path of movement of cutter elements 59 and positioned for wiping engagement with pavement surface 53. Brush 420 is suitably driven to rotate in the same direction as cutter 50 and approximately the same speed to feed pavement rubble behind cutter 50 upwardly and forwardly to join that brought over the top of cutter 50 for movement by the brush 42 rearwardly toward and into the mold board funneling portion 322. The mold board funneling portion may be provided with a forwardly extending ledge or wiper plate 426 extending the length of mold board 70 and at the level of mold board portion 326, to the level of mold board portion 326, to catch the loose rubble and guide it to and into funneling portion 322.

Brush 420 is driven by a hydraulic motor arrangement similar to motors 64 (not shown), and assuming a thirty six inch external diameter for side wall 57 of cutter 50, the brush may have an external diameter of approximately twenty seven inches, in a preferred embodiment.

While the machine herein disclosed is particularly adapted for roadway surface planing purposes, it is also suitable for use in any situation where grade profiling, surfacing, resurfacing or earth or ground removal is to be effected, such as in connection with airport landing strips, auto parking lots, land development resurfacing and profiling, mining operations, sport facilities, etc.

The foregoing description and the drawings are given merely to explain and illustrate the invention and the invention is not to be limited thereto, except insofar as the appended claims are so limited, since those skilled in the art who have the disclosure before them will be able to make modifications and variations therein without departing from the scope of the invention.

I claim:

1. A pavement planing machine for roadways and the like, said machine comprising:

a frame having a forward end and a rearward end, a pair of forward drive assemblies disposed in side by side spaced apart relation at the frame forward end upon which said frame forward end rests, said drive assemblies being connected to said frame for independent vertical adjustment of said frame relative to the respective forward drive assemblies, a rearward drive assembly adjacent the rearward end of said frame on which said frame rearward end rests, means for pivotally connecting said rearward end drive assembly to said frame for pivotal movement of said frame about a horizontal axis extending forwardly and rearwardly of said frame and centered adjacent the midportion of said frame, said drive assemblies being at a level that is below said horizontal axis, said frame having fixed to same on either side of same a depending side sheet, with said side sheets extending downwardly to said level, a planing cylinder journaled at said level between said side sheets to extend transversely of said frame and be disposed at said level, for planing engagement with the pavement, said cylinder being disposed intermediate said frame ends, whereby vertical adjustment of said frame relative to the respective forward drive assemblies effects truing of said planing cylinder relative to the pavement for planing excisement of same free of vertical adjustment requirement of said frame relative to said frame rear drive assembly, means for driving said cylinder to rotate relative to said frame in the direction whereby the cylinder underside moves forwardly of said frame, and comprising a separate drive device mounted on said frame at each end of said cylinder and received within the respective cylinder ends and coupled to said cylinder within same, said cylinder having external surfacing including means for fragmenting the pavement in planing same when rotated in said direction against the pavement surface when said machine is moved forwardly for upcutting excisement of the pavement, said cylinder surfacing extending lengthwise of said cylinder into close proximity to said side sheets, said drive assemblies including drive means for moving said machine forwardly along the pavement for moving said planing cylinder, when said cylinder is driven by said cylinder drive means in said direction, relative to the pavement, in the forward direction for planing excisement of the pavement, with the mass of said machine that is supported by said drive assemblies being oriented to dispose the center of gravity thereof above and in substantial vertical alignment with the forwardly disposed side portion of said planing cylinder external surfacing for countering upward forces acting on said cylinder on forward movement of said machine with said cylinder rotating in said direction thereof for said planing excisement of the pavement, said machine further including separate power jack means interposed between the respective forward drive assemblies and said frame for selectively shifting said frame forward end vertically of the respective forward drive assemblies and about said axis for effecting setting of said planing cylinder relative to the pavement at the desired planing levels and slope, whereby said machine mass as centered at said center of gravity is available to bear on the pavement being excised, on forward movement of said machine with said cylinder rotating in said direction thereof for said planing excisement of the pavement, through said cylinder, to resist shifting of said cylinder from said setting thereof, a mold board extending crosswise of said frame adjacent said planing cylinder and disposed rearwardly of and substantially paralleling said planing cylinder, said mold board being carried by said frame at said drive assembly level forwardly of said rearward drive assembly and said pivotal connecting means thereof, said mold board being positioned to receive and move forwardly, on forward movement of said machine along the pavement, pavement rubble formed by said rotation of said cylinder and moved over the top of said cylinder by said rotation of said cylinder, said mold board being formed to define a pavement rubble passing port opening rearwardly of said frame, an upright pavement rubble retainer fixed to said frame at said drive assembly level adjacent to but forwardly of said cylinder for holding adjacent said cylinder surfacing pavement rubble displaced by said planing excisement of said cylinder for movement over the top of said cylinder under said rotation of said cylinder, said planing cylinder surfacing including auger means for feeding the pavement rubble adjacent same laterally of said cylinder to said mold board port for passage therethrough rearwardly of said frame, and conveyor means carried by said frame and having a pavement rubble receiving end disposed at said drive assembly level in pavement rubble receiving relation with said mold board port forwardly of said rearward end drive assembly connecting means and below said horizontal axis level and a pavement rubble discharge end projecting rearwardly of said frame for conveying the pavement rubble for discharge from the rearward end of said frame.

2. The machine set forth in claim 1 wherein:

said mold board and said conveyor means receiving end have a common support connected to said frame for vertical adjustment movement with respect to said frame and said cylinder, and power means for selectively vertically adjusting said common support relative to said frame.

3. The machine set forth in claim 1 wherein:

said side sheets each have fixed to same on the insides of same a hub, with said hubs being coaxially aligned and said cylinder being journalled on and between said hubs, said hubs each having a driving motor mounted within same and coupled to said cylinder and comprising one of said cylinder drive devices, said cylinder overlying said hubs.

4. The machine set forth in claim 1 wherein:

said center of gravity is elevationally located to be adjacent the level of said horizontal axis.

5. The machine set forth in claim 3 wherein:

said side sheets are mounted for limited flexing movement sidewise of said frame whereby said hubs have self alignment with respect to said cylinder.

6. The machine set forth in claim 1 wherein:

said planing cylinder comprises a framework having an external cylindrical shell externally studded for gouging type break up action of the pavement when said planing cylinder is rotated thereagainst and forming said fragmenting means, said cylinder drive means being coupled to said cylinder framework, said shell being formed by shell segments removably connected to said planing cylinder framework, whereby said shell segments may be replaced while said cylinder remains coupled to said cylinder drive means.

7. The machine set forth in claim 1 wherein:

said means for pivotally connecting said rearward end drive assembly to said frame comprises:

a yoke structure having a central section pivotally connected to said frame to form said horizontal axis and defining end portions disposed on either side of said horizontal axis each riding on a separate drive assembly and forming said rearward drive assembly, said conveyor means extending under said yoke structure central section and between said yoke structure drive assemblies.

8. The machine set forth in claim 7 wherein:

said mass of said machine that is supported by said drive assemblies is distributed for substantially equal load supporting thereof at either end of said frame by said forward drive assemblies and said yoke structure drive assemblies.

9. The machine set forth in claim 1 wherein:

said conveyor means rubble discharge end projects diagonally upwardly of said frame rearwardly thereof and above said horizontal axis level for rubble discharge at a level above said frame.

10. The machine set forth in claim 9 wherein said conveyor means comprises:

a first endless conveyor of rectilinear configuration defining said receiving and discharge ends thereof, and a second endless conveyor of rectilinear configuration cantilever supported from said first conveyor adjacent said discharge end of said first conveyor and projecting rearwardly of said frame, said first conveyor inclining upwardly rearwardly of said frame at an angle approximating thirty degrees relative to said frame and extending rearwardly of and above the level of said rearward drive assembly connecting means and above the level of said horizontal axis, said second conveyor inclining upwardly rearwardly of said frame at an angle approximating ten degrees relative to said frame, said second conveyor having a pavement rubble receiving end disposed in pavement rubble receiving relation with said first conveyor discharge end and a pavement rubble discharge end for discharging pavement rubble therefrom, said conveyors being proportioned lengthwise thereof to receive under same the forward end of a highway dump vehicle and overlie same for discharging the pavement rubble from the second conveyor discharge end into the highway vehicle.

11. The machine set forth in claim 10 wherein:

said second conveyor is articulated to said first conveyor adjacent said first conveyor discharge end for folding to an inoperative position overlying said frame and extending fowardly thereof.

12. The machine set forth in claim 10 including:

means for driving both said conveyors from a common prime mover, said prime mover being located adjacent said first conveyor discharge end.

13. The machine set forth in claim 1 including:

a rotary brush journalled on said machine between said planing cylinder and said mold board at said drive assembly level and having its periphery substantially tangent to the path of movement of said cylinder fragmenting means, and means for rotating said brush in the same direction as said cylinder rotates, said brush periphery being positioned relative to said mold board to have its upper protion at least at the level of said mold board port, and means for funneling pavement rubble from the brush periphery upper portion to said port.

14. A pavement planing machine for roadways and the like, said machine comprising:

a frame having a forward end and a rearward end, a pair of forward drive assemblies disposed in side by side spaced apart relation at the frame forward end upon which said frame forward end rests, said drive assemblies being connected to said frame for independent vertical adjustment of said frame relative to the respective forward drive assemblies, a rearward drive assembly adjacent the rearward end of said frame on which said frame rearward end rests, means for pivotally connecting said rearward end drive assembly to said frame for pivotal movement of said frame about a horizontal axis extending forwardly and rearwardly of said frame and centered adjacent the midportion of said frame, a planing cylinder journaled on said frame to extend crosswise of same and below said axis for planing engagement with the pavement, said cylinder being disposed intermediate said frame ends and substantially paralleling said frame forward and rearward ends, whereby vertical adjustment of said frame relative to the respective forward drive assemblies effects truing of said planing cylinder relative to the pavement for planing excisement of same free of vertical adjustment requirement of said frame relative to said frame rear drive assembly, means for driving said cylinder to rotate relative to said frame in the direction whereby the cylinder underside moves forwardly of said frame, said cylinder having external surfacing including means for fragmenting the pavement in planing same when rotated in said direction against the pavement surface when said machine is moved forwardly, said drive assemblies including drive means for moving said machine forwardly along the pavement for moving said planing cylinder, when driven by said cylinder drive means in said direction, relative to the pavement in the forward directions for planing excisement of the pavement, with the mass of said machine that is supported by said drive assemblies being oriented to dispose the center of gravity thereof above and in substantial vertical alignment with the forwardly disposed side portion of said planing cylinder external surfacing, and with the said mass of said machine that is supported by said drive assemblies being distributed for substantially equal load supporting thereof at either end of said frame by said drive assemblies, said machine further including separate power jack means interposed between the respective forward drive assemblies and said frame for selectively shifting said frame forward end vertically of the respective forward drive wheeled assemblies and about said axis for effecting setting of said planing cylinder relative to the pavement at the desired planing levels and slope, a mold board extending crosswise of said frame adjacent said planing cylinder and disposed rearwardly of and substantially paralleling said planing cylinder, said mold board being carried by said frame at the level of said planing cylinder and being positioned to receive and move forwardly, on forward movement of said machine along the pavement, pavement rubble formed by said rotation of said cylinder and moved over the top of said cylinder by said rotation of said cylinder, said mold board being formed to define a pavement rubble passing port opening rearwardly of said frame, said planing cylinder surfacing including auger means for feeding the pavement rubble, formed by said rotation of said cylinder on said forward movement of said machine along the pavement, laterally of said cylinder to said mold board port for passage therethrough rearwardly of said frame, and conveyor means carried by said frame and having a pavement rubble receiving end disposed in pavement rubble receiving relation with said mold board port forwardly of said rearward end drive assembly connecting means and below the level of said horizontal axis and a pavement rubble discharge end projecting rearwardly of said frame for conveying the pavement rubble for discharge from the rearward end of said frame, said planing cylinder comprising a framework having an external cylindrical shell externally studded for gouging type break up action of the pavement when said planing cylinder is rotated thereagainst and forming said fragmenting means, said coupling means being connected to said cylinder framework, said shell being formed by shell segments removably connected to said planing cylinder framework, whereby said shell segments may be replaced while said cylinder remains coupled to said motor means of said cylinder drive means.

15. The machine set forth in claim 14 wherein said conveyor means comprises:

a first endless conveyor of rectilinear configuration defining said receiving and discharge ends thereof, and a second endless conveyor of rectilinear configuration cantilever supported from said first conveyor adjacent said discharge end of said first conveyor and projecting rearwardly of said frame, said first conveyor inclining upwardly rearwardly of said frame at an angle approximating thirty degrees relative to said frame and extending rearwardly of and above the level of said rearward drive assembly connecting means and above the level of said horizontal axis, said second conveyor inclining upwardly rearwardly of said frame at an angle approximating ten degrees relative to said frame, said second conveyor having a pavement rubble receiving end disposed in pavement rubble receiving relation with said first conveyor discharge end and a pavement rubble discharge end for discharging pavement rubble therefrom, said conveyors being proportioned lengthwise thereof to receive under same the forward end of a highway dump vehicle and overlie same for discharging the pavement rubble from the second conveyor discharge end into the highway vehicle, said second conveyor being articulated to said first conveyor adjacent said first conveyor discharge end for folding to an inoperative position overlying said frame and extending forwardly thereof.

* * * * *